US012252822B2

(12) United States Patent
Koppal et al.

(10) Patent No.: US 12,252,822 B2
(45) Date of Patent: Mar. 18, 2025

(54) BRAID SEPARATION APPARATUS

(71) Applicant: SEA6 ENERGY PVT. LTD., Bangalore (IN)

(72) Inventors: Siddarth Koppal, Bangalore (IN); Jiju Thomas, Kerala (IN); Nelson Vadassery, Bangalore (IN)

(73) Assignee: SEA6 ENERGY PVT. LTD., Bangalore (IN)

( * ) Notice: Subject to any disclaimer, the term of this patent is extended or adjusted under 35 U.S.C. 154(b) by 0 days.

(21) Appl. No.: 18/716,902

(22) PCT Filed: Jan. 31, 2023

(86) PCT No.: PCT/IN2023/050088

§ 371 (c)(1),
(2) Date: Jun. 5, 2024

(87) PCT Pub. No.: WO2023/148759

PCT Pub. Date: Aug. 10, 2023

(65) Prior Publication Data

US 2024/0417899 A1 Dec. 19, 2024

(30) Foreign Application Priority Data

Feb. 1, 2022 (IN) ..... 202241005497

(51) Int. Cl.
*D04C 7/00* (2006.01)
*B65H 54/28* (2006.01)
(Continued)

(52) U.S. Cl.
CPC ..... *D04C 3/00* (2013.01); *B65H 54/2812* (2013.01); *D04C 3/06* (2013.01); *D04C 3/18* (2013.01); *D04C 7/00* (2013.01)

(58) Field of Classification Search
CPC ... D04C 3/00; D04C 3/06; D04C 3/18; D04C 7/00; B65H 54/2812
(Continued)

(56) References Cited

U.S. PATENT DOCUMENTS 153,320 A * 7/1874 Defrees ..... D04C 3/00 87/42
2,831,389 A * 4/1958 Carten ..... D04C 1/02 87/54
(Continued)

FOREIGN PATENT DOCUMENTS

WO 2004/064568 A1 8/2004
WO 2004/093525 A2 11/2004
WO WO-2021138554 A1 * 7/2021 ..... A44C 27/00

OTHER PUBLICATIONS

Internation Search Report and Written Opinion of the International Search Authority dated May 12, 2023 for corresponding Internation Application No. PCT/IN2023/050088. (11 pages).

*Primary Examiner* — Shaun R Hurley
(74) *Attorney, Agent, or Firm* — Seed IP Law Group LLP

(57) ABSTRACT

A braid separation apparatus for separating rope strands of a braided rope, thereby allowing reuse of the separated rope strands, is provided and may include an input assembly configured to move a braided rope made of at least three rope strands, into the apparatus. Further, the apparatus may comprise three or more winding carriers, each being coupled to one of the rope strands. The winding carriers configured to move about each other in serpentine path such that rope strands of the braided rope are separated. Each winding carrier may comprise a spool which is connected to the rope strand coupled to the winding carrier. Each winding carrier may further comprise a torque creating unit configured to
(Continued)

provide a torque on the spool and to cause the spool to rotate such that the rope strand is wound around the spool.

13 Claims, 7 Drawing Sheets

(51) Int. Cl.
*D04C 3/00* (2006.01)
*D04C 3/06* (2006.01)
*D04C 3/18* (2006.01)

(58) Field of Classification Search
USPC ..... 57/2.3, 2.5
See application file for complete search history.

(56) References Cited

U.S. PATENT DOCUMENTS

| | | | | |
|---|---|---|---|---|
| 3,825,197 | A | 7/1974 | Deuker et al. | |
| 3,866,403 | A * | 2/1975 | Zimmermann, Jr. .. | B65H 49/28 57/352 |
| 5,392,683 | A | 2/1995 | Farley | |
| 5,988,181 | A * | 11/1999 | Gable ..... | D04C 7/00 132/200 |
| 7,069,935 | B2 * | 7/2006 | Bousfield ..... | D04C 3/06 132/212 |
| 7,493,746 | B1 * | 2/2009 | Zielinsky ..... | D05B 95/00 57/2.3 |
| 10,609,998 | B2 * | 4/2020 | Callis, Jr. ..... | A45D 2/00 |
| 2018/0327945 | A1 * | 11/2018 | Whitehead ..... | D04C 3/42 |

* cited by examiner

BRAID SEPARATION APPARATUS

BACKGROUND

Description of the Related Art

Generally, braided ropes are used for a variety of applications ranging from load bearing to sailing. A braided rope is a rope that is made by three or more rope strands intertwined amongst themselves in a complex arrangement. In general, braided ropes have been difficult to recycle. A braided rope is a rope that is made by three or more rope strands intertwined amongst themselves in a complex arrangement. Conventionally, the only way to recycle such braided ropes has been to melt the braided rope (if it is a thermoplastic polymer) and then use the melted (i.e., recycled) material of the braided rope either to make the rope strands again or for another application. However, melting and recreating the rope strands from the recycled material typically results in rope strands with a lower strength than that of the original rope strand, and the recycled material must either be blended with virgin polymer material or used for lower grade applications. Also, a braided rope commonly includes many rope strands but the braided rope may include as few as one or two rope strands, which may be damaged. Conventionally, the only solution is to discard the braided rope or recycle the material of the braided rope. Recycling, however, is not possible through the conventional mechanism for braided ropes made of natural fiber, or from thermoset materials, such as aramide.

The separation of the braided ropes may be performed by hand. However, this may be a tedious and a time-consuming process. Additionally, the resulting rope strands may include kinks or residual twists thereon, which may cause the rope strands to be harder to reuse and may cause the rope strands to entangle easily.

BRIEF SUMMARY

The present disclosure provides braid separation apparatuses configured to unwind rope strands of a braided rope onto spools, such that a maximum portion of the braided rope strands may be reused. In some embodiments, a braid separation apparatus comprises an input assembly. The input assembly is configured to move a braided rope into the apparatus. The braided rope is made up of three or more rope strands. The apparatus further comprises three or more winding carriers. Each one of the winding carriers is coupled to one of the rope strands of the braided rope. The three or more winding carriers are configured to move about each other in a serpentine path to separate the rope strands of the braided rope. Each of the three or more winding carriers comprises a spool. The spool is connected to the rope strand coupled to the winding carrier. Each of the three or more winding carriers further comprises a torque creating unit. The torque creating unit is configured to provide a torque on the spool and to rotate the spool such that the rope strand is wound around the spool.

The apparatuses of the present disclosure are superior to the conventional systems as the proposed apparatuses enable separation of the rope strands of the braided rope and reuse of the separated rope strands to braid and form the braided rope again. The apparatuses described herein may be utilized when a braided rope is used temporarily to embed or hold some material in place. For example, braided ropes may be used to embed seaweeds within the matrix of the rope strands, which may be laid out to grow in the sea. However, after the growth of seaweeds and subsequent harvesting, the braided rope may not be used as in its current state. The braided rope needs to be separated into constituent strands and then braided again while embedding seaweeds within. The present disclosure enables reuse of the braided rope after the growth of seaweeds and subsequent harvesting by allowing separation of the rope strands and winding the separated rope strand around the spool.

The apparatuses of the present disclosure provide a mechanical assembly for separating rope strands of a braided rope, which minimizes residual twists in the rope strands by separating the rope strands of the braided rope in a reverse order in which the braided rope was created.

The apparatuses described herein may be used for braided ropes which have been created using a braiding machine involving serpentine tracks.

The description hereinafter describes the apparatuses, as per the present disclosure. The manner in which the apparatuses may be implemented has been explained in detail with respect to FIG. 1 to FIG. 12.

BRIEF DESCRIPTION OF THE DRAWINGS

The features, aspects, and advantages of the subject matter will be better understood with regard to the following description, and accompanying figures. The use of the same reference number in different figures indicates similar or identical features and components.

DETAILED DESCRIPTION

It should be noted that the description and figures merely illustrate the principles of the present disclosure. It will thus be appreciated that those skilled in the art will be able to devise various arrangements that, although not explicitly described herein, embody the principles of the present disclosure and are included within its scope. Furthermore, all examples recited herein are intended only to aid the reader in understanding the principles of the present disclosure. Moreover, all statements herein reciting principles, aspects and implementations of the present disclosure, as well as specific examples thereof, are intended to encompass equivalents thereof.

Figure 1:
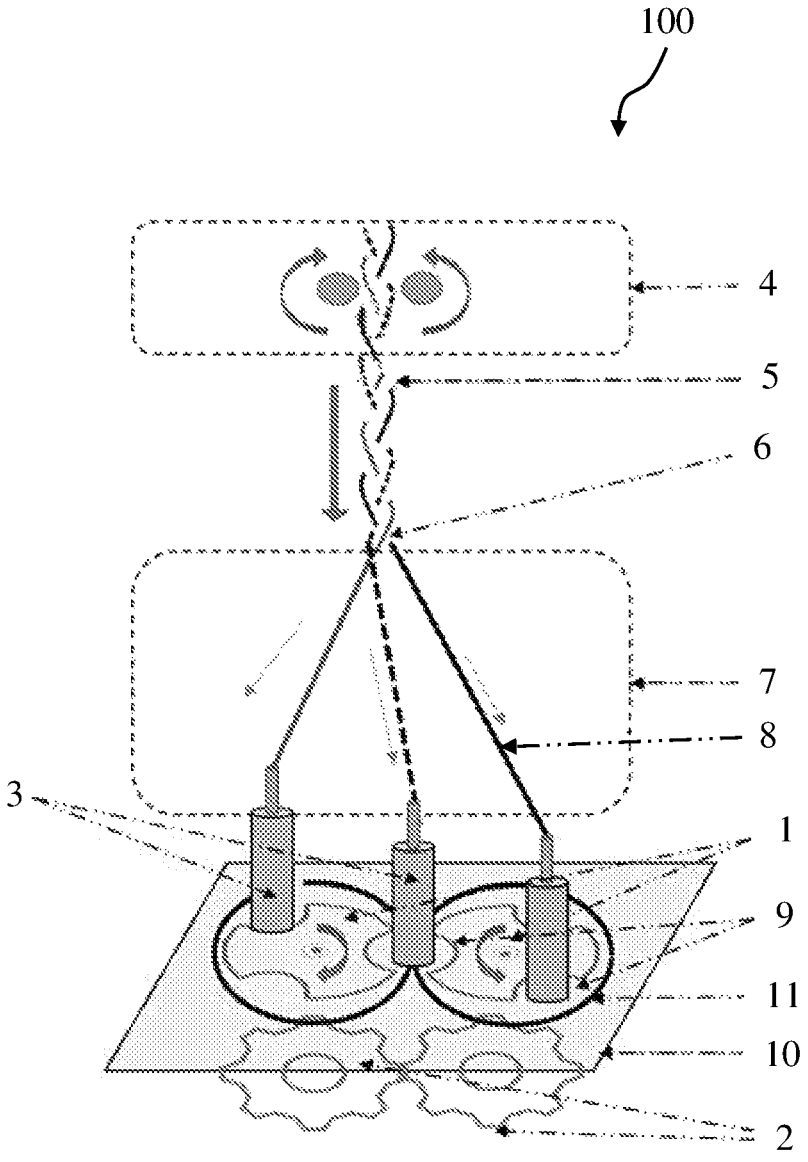
FIG. 1 illustrates an example braid separation apparatus, in accordance with an implementation of the present subject matter.

FIG. 1 illustrates an example embodiment of a braid separation apparatus 100. The braid separation apparatus 100 comprises an input assembly 4. The input assembly 4 is configured to move a braided rope 5 into the apparatus 100. The braided rope 5 includes at least three rope strands 8. The input assembly 4 is configured to move the braided rope 5 into the apparatus 100 at a set rate. The input assembly 4 may be a system of contrarotating rollers, contrarotating caterpillar tracks or a spool/capstan which is configured to move the braided rope 5 while maintaining tension.

Figure 2:
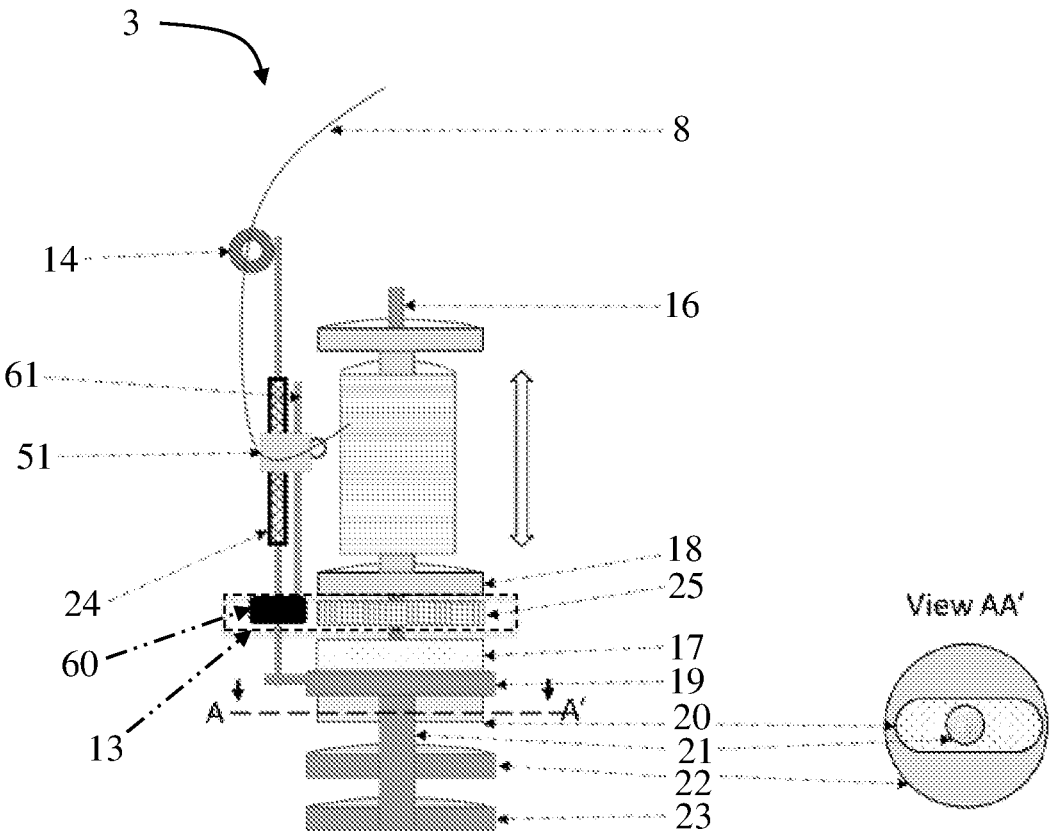
FIG. 2 illustrates a detailed view of a winding carrier of a braid separation apparatus, in accordance with an implementation of the present subject matter.

The braid separation apparatus 100 further comprises three or more winding carriers 3. Each one of the winding carriers 3 is coupled to one of the rope strands 8 of the braided rope 5. The three or more winding carriers 3 are configured to move about each other in a serpentine path to separate the rope strands 8 of the braided rope 5. The rope strands 8 of the braided rope 5 may be split at a separation point 6 in an untwining zone 7 and are wound onto their respective spools (e.g., spool 18 is illustrated in FIG. 2) in the winding carriers 3. The separation point 6 is a point where the rope strands 8 pass alternatively over and under each other separating the rope strands 8 of the braided rope 5. The untwining zone 7 is a region from the separation point 6, until where the rope strands 8 are wound onto the respective spools in the winding carriers 3. If the winding carriers 3 were fixed and the rope strands 8 were to be wound, the spools would become stuck as all the rope strands 8 are intertwined in the braided rope 5. To separate the rope strands 8 of the braided rope 5, the winding carriers 3 are configured to be moved in a particular orientation, such as a serpentine path 11, such that tracks of the winding carriers 3 approximately sketch the figure "8" (eight) at the bottom. The separating of the rope strands 8 of the braided rope 5 may be caused by the winding carrier 3 interacting with a slot gear assembly having slot gears 1 and coaxial gears 2.

The slot gear assembly is coupled to the winding carriers 3. The slot gear assembly moves the winding carriers 3 in the serpentine path 11. The slot gears 1 of the slot gear assembly, which are counter rotating to each other and each of which contains slots 9 along their circumference, are aligned in such a way that the slots 9 of two neighboring slot gears 1 are aligned while the slot gears 1 rotate. The slot gears 1 are powered by a set of coaxial gears 2 positioned below the slot gears 1. Each of these coaxial gears 2 are configured to mesh with the neighboring coaxial gear 2 of the slot gear assembly such that all adjacent coaxial gears 2 and the corresponding slot gears 1 rotate opposite to each other.

Any one of these coaxial gears 2 may be energized via a motor, an engine, hand crank or any other means of rotary motion such that the entire slot gear assembly and the winding carriers 3 coupled to the slot gear assembly move.

The apparatus 100 includes a track plate 10, positioned above the slot gear assembly, with the serpentine path 11 cut through the track plate 10. All the winding carriers 3 are configured to move within the serpentine path 11.

FIG. 2 illustrates a detailed view of the winding carrier 3. Each winding carrier 3 has a projection 21, positioned on the side facing the slot gear assembly, which is configured to fit within the slot 9 of the slot gear 1. As the slot gear 1 rotates, the winding carrier 3 is configured to move along with the slot 9, until the winding carrier 3 encounters the aligned slot 9 from the neighboring slot gear 1. At this point, the winding carrier 3 is configured to mvoe into the adjacent available slot 9 and moves from one slot gear 1 to another slot gear 1, also changing the direction of rotation of the winding carrier 3. This switching of the winding carrier 3 from one slot 9 to another slot 9 is enabled by the track plate 10 and a special geometry in the winding carrier 3, as can be seen in FIG. 2.

The projection 21, below a carrier base 19 of the winding carrier 3, is configured to fit into the slot 9 of the slot gear 1. The winding carrier may include plates 22 and 23. The plates 22 and 23 sit on either side of the slot gear 1 to provide stability to the winding carrier 3. The portion of the projection 21 which lies between the plates 22 and 23 is configured to be engaged by the slot 9 of the slot gear 1. The winding carrier 3 is configured to rotate with the slot gear 1 until it comes to the point where the slot 9 of one slot gear 1 aligns with the slot 9 of the adjacent slot gear 1.

Below the carrier base 19 of the winding carrier 3, the winding carrier 3 includes an elongated section called a guide 20. The guide 20 is configured to move within the serpentine path 11 and the apparatus 100 is configured such that the curvature of the serpentine path 11 enables the guide 20 to move both in a straight line and across the gentle curve of the serpentine path 11 around the slot gears 1. However, the guide 20 is configured to prevent the winding carrier 3 from making a turn with a small radius of curvature. The guide 20 enables the winding carrier 3 to move from the slot 9 of one slot gear 1 to another slot 9 in the adjacent slot gear 1. At the intersection point in the serpentine path 11, a winding carrier 3 has three possible paths: to move straight ahead, to move right, or to move left. The small turning radius needed for the left and right turns effectively prevents the guide 20 in the winding carrier 3 from doing so and causes the guide 20 to move diagonally opposite into the serpentine path 11 surrounding the adjacent slot gear 1.

Each winding carrier 3 includes a spool 18. The spool 18 is connected to the rope strand 8, which is coupled to the winding carrier 3. The winding carrier 3 further includes a shaft 16 configured to carry the spool 18.

Figure 3:
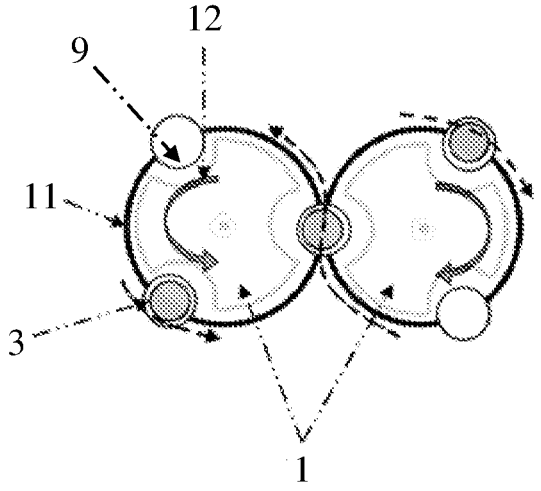
FIG. 3 illustrates movement of winding carriers in the example braid separation apparatus of FIG. 1.

FIG. 3 shows the movement of the winding carriers 3 in the braid separation apparatus 100 of FIG. 1. For example, in FIG. 3, as the slot gears 1 rotate in a rotational direction 12, the first winding carrier 3 coming from the right slot gear 1 (bottom) will move diagonally to the left slot gear 1 (top), while the next winding carrier 3 coming from the left slot gear 1 (bottom) will move diagonally to the right slot gear 1 (top).

This motion of the winding carrier 3 is in a reverse direction relative to how the rope strands 8 were originally braided to form the braided rope 5. As the winding carriers 3 winding up the rope strands 8 move around the path, the rope strands 8 are freed from the braided rope 5.

As can be seen in FIG. 2, the winding carriers 3 are configured to spool the rope strands 8 by maintaining a constant tension on each rope strand 8 and to prevent slack in the rope strands 8. Each winding carrier includes a torque creating unit 17. The torque creating unit 17 is configured to provide a torque on the spool 18 and to rotate the spool 18 such that the rope strand 8 is wound around the spool 18. The torque creating unit 17 is configured to rotate the spool 18 about the longitudinal axis of the shaft 16. The shaft 16 is rotated by the torque creating unit 17 for rotating the spool 18. The torque creating unit 17 is configured to provde a torque on the spool 18 such that the spool may wind the rope strand 8, while maintaining the tension due to the torque never exceeding the safe working load of the rope strand 8. Additionally, a mechanism is provided on the winding spool 18 such that the incoming rope strand 8 is wound around the spool 18 in a typical fashion to maximize the amount of the rope strand 8 that may be fit on the spool 18.

The winding carrier 3 is configured to serves the following functions:

1. Moves along the serpentine path 11 on the track plate 10 such that the winding carrier 3 shifts from one slot gear 1 to another slot gear 1.
2. Carries a spool 18 which is configured to wind the rope strand 8 freed up by the motion of the winding carriers 3 along the serpentine path 11.
3. Arranges the rope strand 8 in a regular fashion on the spool 18 while the rope strand 8 is being spooled, such that the entire space on the spool 18 is efficiently utilized to store a maximum amount of rope strand 8.

Several embodiments may provide the functionality described above. For example, in an embodiment such as is shown in FIG. 2, the spool 18 may move in a to and fro motion along the shaft 16 and such that the rope strand 8 is wound around the spool 18 uniformly throughout a winding length of the spool 18. The winding length of the spool 18 is the length of the spool 18 around which the rope strand 8 may be wound. The spool 18 may be configured to move in the to and fro motion at a certain rate proportional to its rotation along a rotational axis (i.e., the longitudinal axis of the shaft 16) while the incoming eyelet of a cylinder head 51 is fixed.

In a further embodiment, the cylinder head 51 having the incoming eyelet may be configured to move in a to and fro motion along a double grooved shaft 24, while the spool 18 rotates along the rotational axis while being fixed along the shaft 16. The rope strand 8 may pass through an eyelet 14 before winding onto the spool 18. The cylinder head 51 may be moved in the to and fro motion by way of a guiding assembly (explained in detail with reference to FIG. 10*a*, FIG. 10*b*, FIG. 10*c*, and FIG. 11) comprising a torque transmission unit 13, the double grooved shaft 24, and a linear shaft 61. The torque transmission unit 13 (explained in detail with reference to FIG. 10*a*) includes a first torque transmission unit 25 and a second torque transmission unit 60. This to and fro motion enables winding of the rope strand 8 on the spool 18.

In the braid separation apparatus 100 of FIG. 1, each slot gear 1 may include multiple slots 9 (i.e., between 3 and 6 slots), such that the slots 9 of adjacent slot gears 1 align with each other upon rotation. The number of winding carriers 3 may also increase depending on the number of slots 9 provided to separate the rope strands 8 of the braided rope 5 of different configurations.

In this mechanism, the braided rope 5 is moved into the apparatus 100 via the input assembly 4 in a regulated manner, and as the winding carriers 3 move along the serpentine path 11, the rope strands 8 in the braided rope 5 separate and are spooled into the winding carriers 3 repeatedly until the braided rope 5 is fed completely and the rope strands 8 have been wound around the respective spools 18.

A similar mechanism of braid separation can be extended to apparatuses with n number slot gears 1, where n>1. In some embodiments, the slot gears 1 may be arranged linearly in a line or a curve, where the number of slot gears 1 is n, where n>1. In further embodiments, the slot gears 1 may be arranged in a circular shape, where the number of slot gears 1 is 2n, where n>1.

In the apparatuses in which there are even number of slot gears 1 arranged in a circle, two sets of winding carriers 3 are configured to move around them. In such embodiments, one set of winding carriers 3 is configured to move clockwise, and another set of winding carriers 3 is configured to move counter-clockwise to separate the rope strands 8 of the braided rope 5.

Figure 4:
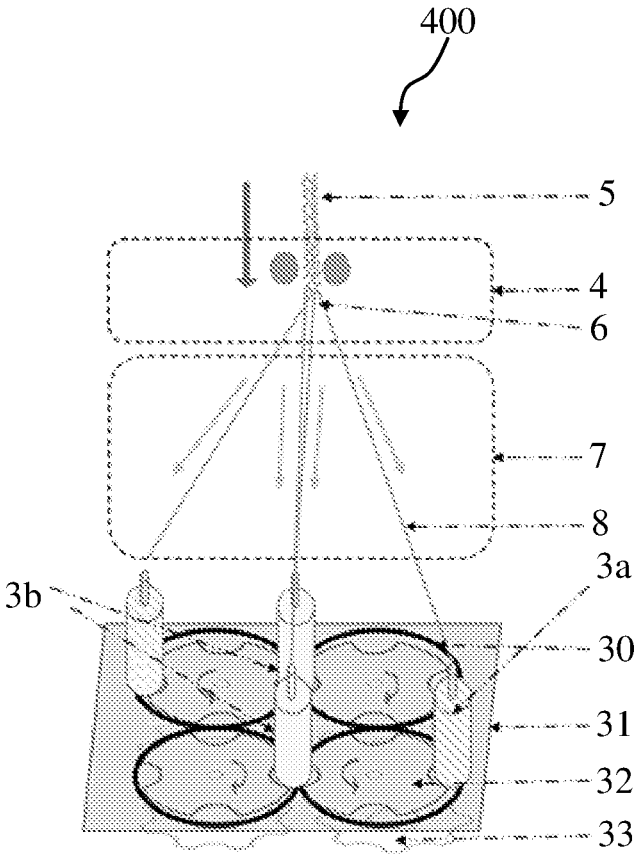
FIG. 4 illustrates an example braid separation apparatus, in accordance with an implementation of the present subject matter.

FIG. 4 illustrates a braid separation apparatus 400 having an input assembly 4 (which is same as the input assembly 4 illustrated in FIG. 1). The braid separation apparatus 400 includes four winding carriers 3*a* and 3*b* and a slot gear assembly with four slot gears 32. The winding carriers 3*b* are configured to move clockwise, and the winding carriers 3*a* are configured to move in the opposite direction about the central point around which all the slot gear axes are circumscribed. Both sets of winding carriers 3*a*, 3*b* alternate between insides and outsides of the slot gears 32, such that paths of the winding carriers 3*a*, 3*b* only intersect at the point the slots of adjacent slot gears 32 are closest to each other. This motion is enabled by a track plate 31 inside which a serpentine path 30 is cut therethrough. The serpentine path 30 enables the guide 20 of the winding carrier 3 to move from one slot gear 32 to another in a serpentine manner such that the paths of the winding carriers 3*a*, 3*b* only intersect and do not share a common arc. The slot gears 32 are mounted on a common shaft with coaxial gears 33.

Figure 5:
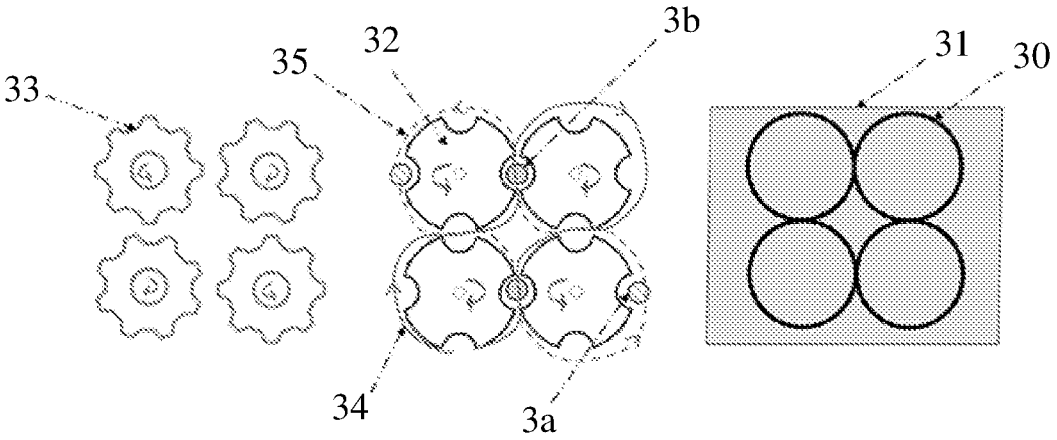
FIG. 5 illustrates a track plate and movement of winding carriers within the track plate in the example braid separation apparatus of FIG. 4.

As can be seen in FIG. 5, the winding carriers 3*a* are configured to follow path 35 and the winding carriers 3*b* are configured to follow path 34 such that the winding carriers 3*a*, 3*b* only intersect at the point where the slots of the slot gears 32 face each other. When a winding carrier 3*a* is moving inward, another winding carrier 3*b* moving in the opposite direction (and vice versa) moves outwards, thereby separating the rope strands 8 and repeating this process repeatedly such that the rope strands 8 of the braided rope 5 separate and are spooled into the winding carriers 3*a* and 3*b*.

Each coaxial gear 33 is configured to mesh with an adjacent coaxial gear 33 such that each set of slot gears 32 and the associated coaxial gears 33 has an alternating rotation direction compared to the coaxial gear 33 and slot gear 32 adjacent to it. This mechanism is configured to be powered by providing rotary motion to any one of the coaxial gears 33 such that the entire slot gear assembly starts moving and the winding carriers 3*a*, 3*b* follow the paths 35 and 34 respectively.

The mechanism is configured such that the braided rope 5 is moved into the apparatus 400 by the input assembly 4 in a regulated manner, and as the winding carriers 3*a* and 3*b* move along the serpentine path 30, the rope strands 8 in the braided rope 5 separate and are spooled into the winding carriers 3*a* and 3*b*. This process repeats until the braided rope 5 is moved completely into the apparatus 400 and the rope strands 8 have been wound around the respective spools 18 of the winding carriers 3*a* and 3*b*.

This motion of the winding carrier 3 is configured to be a reverse direction of how the rope strands 8 were originally braided to form the braided rope 5. As the winding carriers 3 winding up the rope strands 8 continue moving, the rope strands 8 are released from the braided rope 5. To prevent slack in the braided rope 5, the winding carriers 3 are configured to spool the rope strand 8 by maintaining a constant tension on each rope strand 8. This is done by providing a torque on the spool 18 such that the spool may wind up the rope strand 8, ensuring the tension due to the torque never exceeds the safe working load of the rope strand 8. Additionally, a mechanism is provided on the winding spool 18 such that the incoming rope strand 8 is wound around the spool 18 in a regular fashion to maximize the amount of the rope strand 8 that can be fit on the spool 18.

It should be understood that in such an apparatus, the number of slots in each slot gear may be greater than 2, as long as all the slot gears include the same slots and the slots of adjacent slot gears align with each other upon rotation. The number of winding carriers also may vary depending on the kind of braid separation required. For example, the apparatus may have a six slot slot-gear with as few as three winding carriers to as many as 12. In some embodiments, there may be as many carries as half the number of slots. The same apparatus as described above, may include four slot-gears with two slots each, as only four carriers are used. The apparatus described herein may support between three winding carriers to eight winding carriers. As the number of carriers increase, the apparatus must be sufficiently large to accommodate the winding carriers.

Figure 6:
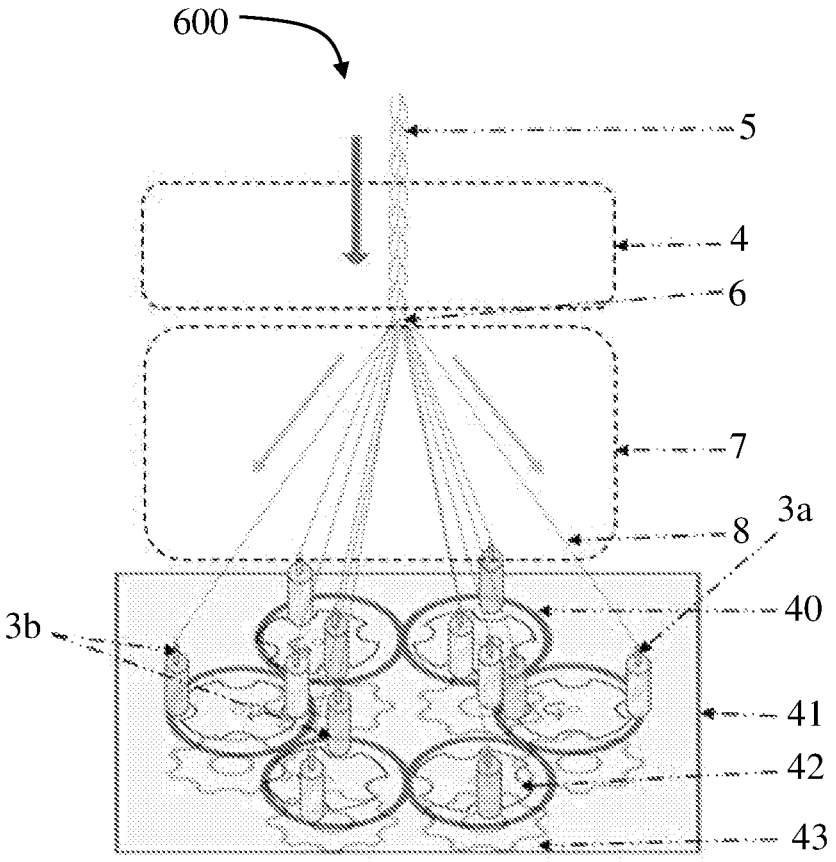
FIG. 6 illustrates an example braid separation apparatus, in accordance with an implementation of the present subject matter.

FIG. 6 shows a braid separation apparatus 600 having an input assembly 4 (which is same as the input assembly 4 illustrated in FIG. 1). The braid separation apparatus 600 includes twelve winding carriers 3*a*, 3*b* and a slot gear assembly with six slot-gears 42. The winding carriers 3*b* are configured to move clockwise, and the winding carriers 3*a* are configured to move in the other direction about the central point around which all the slot gear axes are circumscribed. Both sets of winding carriers 3*a*, 3*b* are configured to alternate between in the insides and outsides of the slot gears 32, such that the paths of the winding carriers 3*a*, 3*b* only intersect at the point the slots of adjacent slot gears 42 are closest to each other. This motion is assisted by a track plate 41 inside of which is a serpentine path 40 cut therethrough. The serpentine path 40 is configured to enable the guide 20 of the winding carrier 3 to move from one slot gear 42 to another in a serpentine manner such that the paths of the winding carriers 3*a*, 3*b* only intersect but do not share a common arc. The slot gears 42 are mounted on a common shaft with coaxial gears 43.

Figure 7:
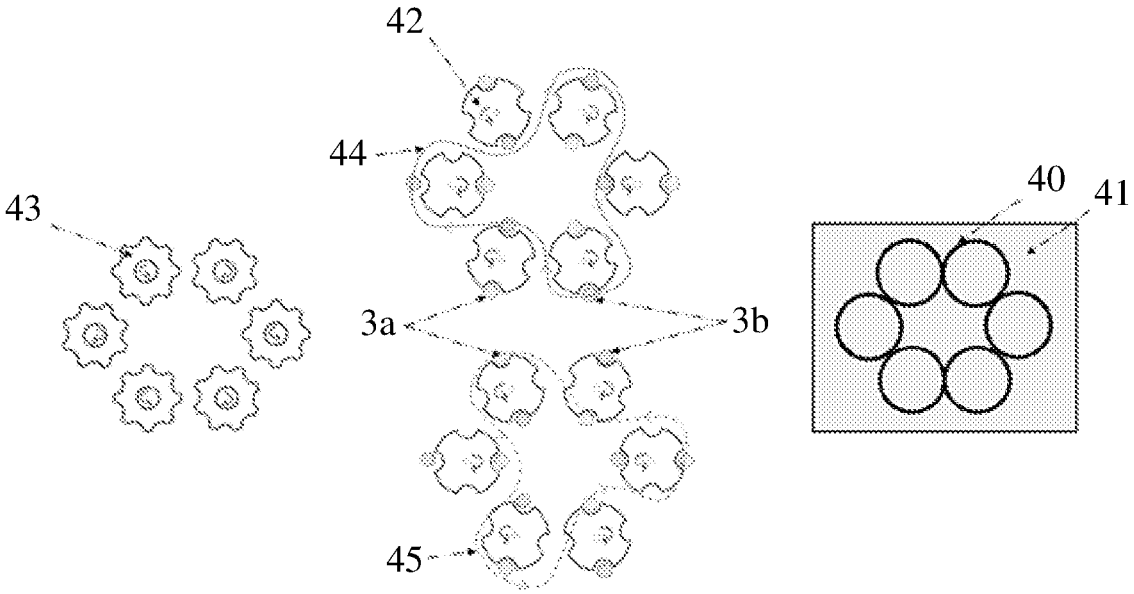
FIG. 7 illustrates a track plate and movement of winding carriers within the track plate in the example braid separation apparatus of FIG. 6.

As can be seen in FIG. 7, the winding carriers 3*a* are configured to follow path 45 and the winding carriers 3*b* are configured to follow path 44 such that they only intersect at the point where the slots of the slot gears 42 face each other. Such a configuration ensures that when a winding carrier 3*a* is moving inward, another winding carrier 3*b* moving in the opposite direction (and vice versa) moves outwards, thereby separating the rope strands 8 of the braided rope 5 and repeating this process repeatedly until the rope strands 8 of the entire braided rope 5 are separated and wound on their respective winding carriers 3*a*, 3*b*.

Each coaxial gear 43 is configured to mesh with adjacent coaxial gear 33 in such that each set of coaxial gears and associated slot gears 32 has an alternating rotation direction compared to the coaxial gear 33 and slot gear 32 adjacent to it. This mechanism is configured to be powered by providing rotary motion to any one of the coaxial gears 43 such that the entire slot gear assembly starts moving and the winding carriers 3*a*, 3*b* follow the paths 45 and 44, respectively.

In this mechanism, the braided rope 5 is configured to be moved into the apparatus 600 by the input assembly 4 in a regulated manner, and as the winding carriers 3*a*, 3*b* move along the serpentine path 41, the rope strands 8 in the braided rope 5 separate and are spooled into the winding carriers 3*a*, 3*b*. Such a process repeats until the braided rope 5 is moved completely into the apparatus 600 and the rope strands 8 have been wound around the respective spools 18 of the winding carriers 3*a*, 3*b*.

This motion of the winding carrier 3 is configured such that it is a reverse direction of how the rope strands 8 were originally braided to form the braided rope 5. As the winding carriers 3 winding the rope strands 8 continue to move, the rope strands 8 are freed from the braided rope 5. To prevent slack in the braided rope 5, the winding carriers 3 are configured to spool the rope strand 8 by maintaining a constant tension on each rope strand 8. This is done by providing a torque on the spool 18 such that the spool 18 can wind up the rope strand 8, while ensuring that the tension due to the torque never exceeds the safe working load of the rope strand 8. Additionally, a mechanism is provided on the winding spool 18 such that the incoming rope strand 8 is wound around the spool 18 in a regular fashion to maximize the amount of the rope strand 8 that can be fit on the spool 18.

It should be understood that in such an apparatus, the number of slots in each slot-gear may be greater than 3, as long as all the slot gears have the same slots and the slots of adjacent slot gears align with each other upon rotation. The number of winding carriers also may vary depending on the kind of braid separation desired, up to a maximum of half the total number of slots in the apparatus. The arrangement of the winding carriers within the slots may also vary depending on the kind of braid separation required.

The mechanism of braid separation may be extended to apparatuses with odd numbered slot-gears also.

Figure 8:
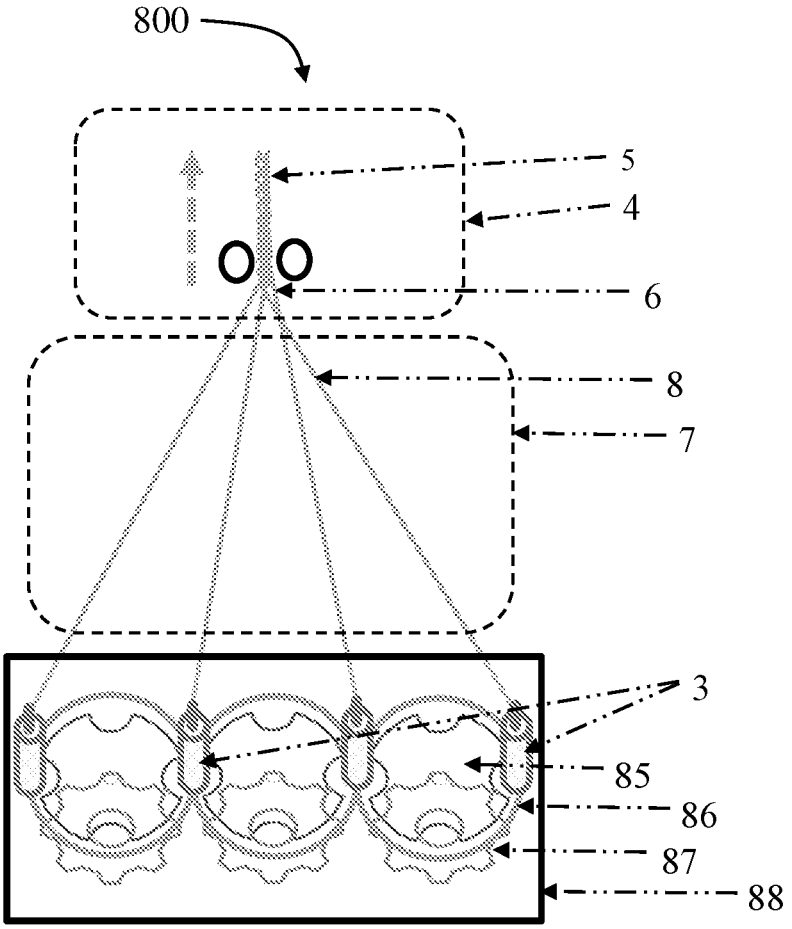
FIG. 8 illustrates an example braid separation apparatus, in accordance with an implementation of the present subject matter.

FIG. 8 illustrates a braid separation apparatus 800 having an input assembly 4 (which is same as the input assembly 4 illustrated in FIG. 1). The braid separation apparatus 800 includes four winding carriers 3 and a slot gear assembly with three slot-gears 85. The winding carriers 3 are arranged around a single intersecting serpentine path 86. The winding carriers 3 are configured to move in one direction for one half of the length of the serpentine path 86 and to reverse their direction when the winding carriers 3 reach the boundary of the serpentine path 86. The serpentine path 86 intersects itself twice at the point the slots of adjacent slot gears 85 align themselves and are closest to each other. This motion is assisted by a track plate 88 inside which the serpentine path 86 is cut therethrough. This serpentine path 86 is configured to enable the guide 20 of the winding carrier 3 to move from one slot gear 85 to another in a serpentine manner. The slot gears 85 are mounted on a common shaft with coaxial gears 87.

Figure 9:
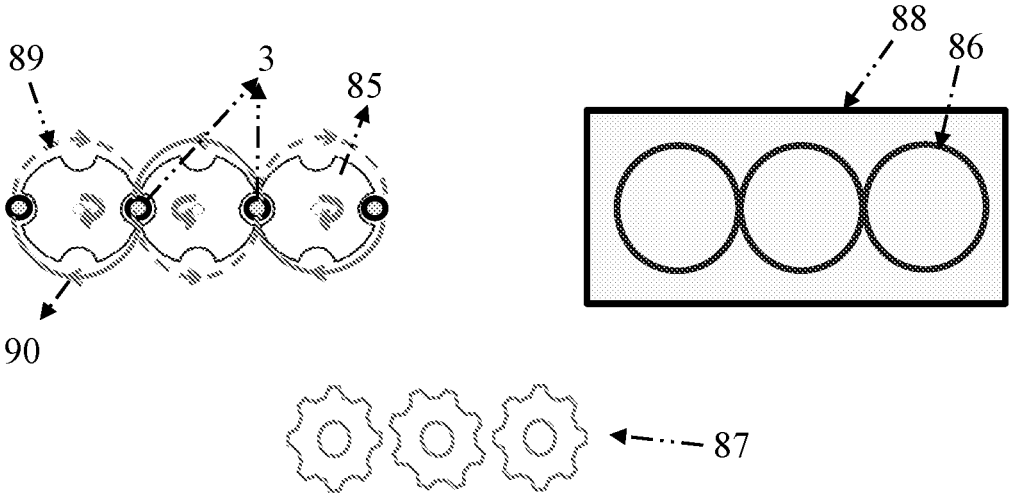
FIG. 9 illustrates a track plate and movement of winding carriers within the track plate in the example braid separation apparatus of FIG. 8.

As can be seen in FIG. 9, the winding carriers 3 are configured to follow path 89 along the dashed line for one half of their length and to reverse their direction to move along path 90 on the solid line when the carriers 3 reach the boundary of the serpentine path 86. This motion continues repeatedly. This motion results in separating the four rope strands 8 from the flat braided rope 5. Such a process repeats such that the rope strands 8 of the braided rope 5 separate and are spooled into the winding carriers 3.

Each coaxial gear 87 is configured to mesh with adjacent coaxial gear 87 in such that each set of coaxial gears 87 and the associated slot gear 85 has an alternating rotation direction compared to the coaxial gear 87 and slot gear 85 adjacent to it. This mechanism is configured to be powered by providing rotary motion to any one of the coaxial gears 87 such that the entire slot gear assembly starts moving and the winding carriers 3 follow the combined path 89 and 90.

In this mechanism, the flat braided rope 5 is configured to be moved into the apparatus 800 by the input assembly 4 in a regulated manner, and as the winding carriers 3 move along the serpentine path 86, the rope strands 8 in the flat braided rope 5 separate and are spooled into the winding carriers 3. Such a process repeats itself until the braided rope 5 is moved completely into the apparatus 800 and the rope strands 8 have been wound around the respective spools 18 of the winding carriers 3.

This motion of the winding carrier 3 is configured such that it is a reverse direction of how the rope strands 8 were originally braided to form the flat braided rope 5. As the winding carriers 3 winding up the rope strands 8 continue to move, the rope strands 8 are freed from the flat braided rope 5. To slack in the braided rope 5, the winding carriers 3 are configured to spool the rope strand 8 by maintaining a constant tension on each rope strand 8. This is done by providing a torque on the spool 18 such that it can wind the rope strand 8, while ensuring that the tension due to the torque never exceeds the safe working load of the rope strand 8. Additionally, a mechanism is provided on the winding spool 18 such that the incoming rope strand 8 is wound around the spool 18 in a regular fashion to maximize the amount of the rope strand 8 that can be fit on the spool 18.

It should be understood that in such an apparatus, the number of slots in each slot gear may be two or more, as long as the slots of adjacent slot gears align with each other upon rotation. The number of winding carriers and the arrangement of winding carriers within the slots may also vary depending on the kind of braid separation required.

In some example embodiments, where the slot gears in an apparatus are arranged linearly in a line or a curve, for example, in the apparatus illustrated in FIG. 8, all the slot gears may have same number of slots and the size of all the slot gears may be same. In further embodiments, where the slot gears in an apparatus are arranged linearly in a line or a curve, for example, in the apparatuses illustrated in FIG. 8, the number of slots in the slot gears and the size of the slot gears may be different with respect to each other. In the alternative embodiments, the circumferential distance between the slots, i.e., the distance between two slots on a slot gear as measured along the circumference of the slot gear, is substantially similar in all the slot gears such that the slots of adjacent slot gears always align with each other upon rotation.

Figure 10A:
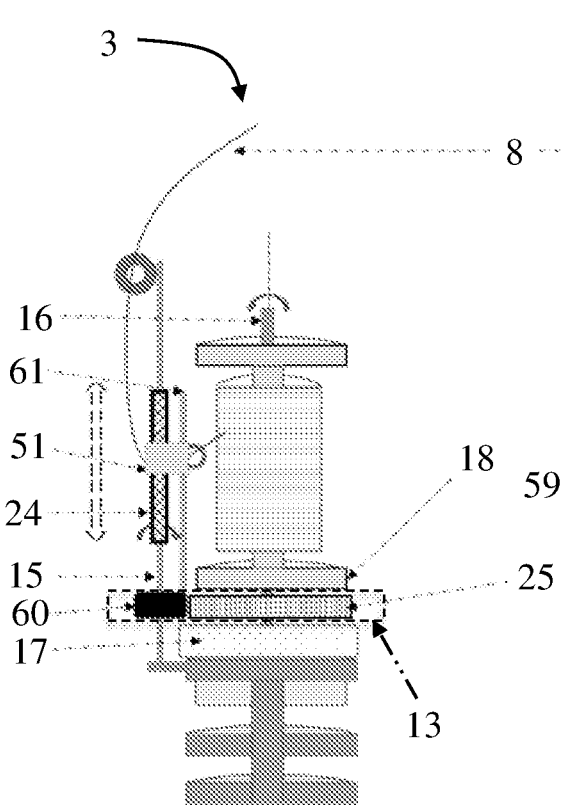
FIG. 10*a* illustrates a detailed view of a winding carrier of a braid separation apparatus, in accordance with an implementation of the present subject matter.
Figure 10B:
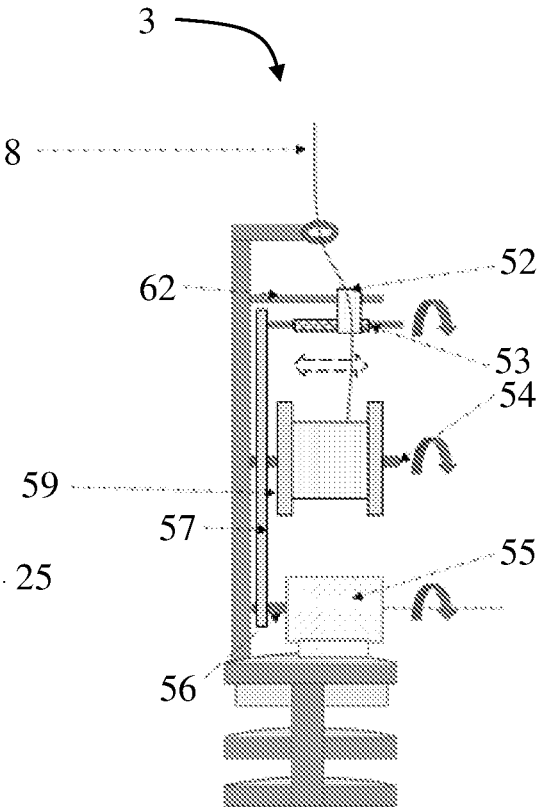
FIG. 10*b* illustrates a detailed view of a winding carrier of a braid separation apparatus, in accordance with an implementation of the present subject matter.
Figure 10C:
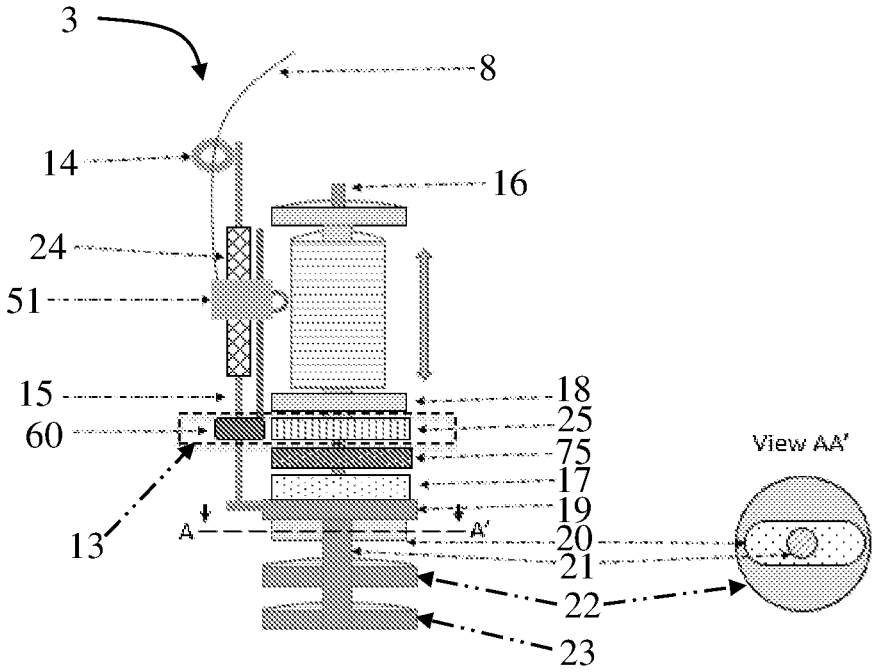
FIG. 10*c* illustrates a detailed view of a winding carrier of a braid separation apparatus, in accordance with an implementation of the present subject matter.

Winding carriers 3 may be configured in many ways providing the function of spooling around the spool 18 or 59 resulting from the separation of rope strand 8 from the braided rope 5. Three example embodiments of the winding carriers are shown in FIG. 10*a*, FIG. 10*b*, and FIG. 10*c*. In each case, the winding carrier 3 includes a spool 18 or 59. The spool 18 or 59 is connected to the rope strand 8 coupled to the winding carrier 3. Further, in each case, the winding carrier 3 includes a torque creating unit 17 or 55. The torque creating unit 17 or 55 is configured to provide a torque on the spool 18 or 59 and to cause the spool 18 or 59 to rotate for winding the rope strand 8 around the spool 18 or 59. The torque creating unit 17 or 55 may be a motor, a coiled spring, or any other known source of torque.

In some embodiments, the winding carrier 3 may include a shaft 16 or 54 to carry the spool 18 or 59. The shaft 16 or 54 may be configured to be rotated by the torque creating unit 17 or 55 for rotating the spool 18 or 59. In an example embodiment (as illustrated in FIG. 2), the spool 18 or 59 may be configured to move in a to and fro motion along the shaft 16 or 54 and to cause the rope strand 8 to be wound around the spool 18 or 59 uniformly throughout a winding length of the spool 18 or 59. The winding length of the spool 18 or 59 is the length of the spool 18 or 59 around which the rope strand 8 may be wound. The spool 18 or 59 may be mounted on the shaft 16 or 54 which rotates at a torque such that the tension never exceeds the breaking strength of the rope strand 8 and that the rope strand 8 is always in tension.

In some embodiments, the winding carrier 3 may include a guiding assembly. The guiding assembly is configured to move the rope strand 8 in a to and fro motion and causes the rope strand 8 to be wound around the spool 18 or 59 uniformly throughout the winding length of the spool 18 or 59.

In FIG. 10*a*, the guiding assembly includes a torque transmission unit 13. The torque transmission unit 13 is configured to be powered by the torque creating unit 17. The guiding assembly further includes a double grooved shaft 24. The double grooved shaft 24 is configured to be rotated by the torque transmission unit 13. In an example embodiment, the guiding assembly may include a linear shaft 15, having the double grooved shaft 24 mounted thereon, which is rotated by the torque transmission unit 13. The torque transmission unit 13 includes a first torque transmission unit 25 and a second torque transmission unit 60. In this case, the first torque transmission unit 25 is configured to be powered by the torque creating unit 17, the second torque transmission unit 60 is configured to be powered by the first torque transmission unit 25, and the linear shaft 15 or the double grooved shaft 24 is configured to be rotated by the second torque transmission unit 60. The first torque transmission unit 25 may be a gear or a belt pulley. The second torque transmission unit 60 may be a gear system or a belt pulley system. The double grooved shaft 24 includes two helical grooves on the curved surface of the double grooved shaft 24. The double grooved shaft 24 may include a right handed helix and a left handed helix on its curved surface. The guiding assembly further includes a cylinder head 51. The cylinder head 51 may be mounted on the double grooved shaft 24. The cylinder head 51 comprises an engaging device or means which is configured to engage with one of the two helical grooves at a time to move the cylinder head 51 linearly over the double grooved shaft 24. The engaging device or means may be a protrusion or an attached ball bearing on an inner side of the cylinder head 51. As the cylinder head 51 moves linearly over the double grooved shaft 24, the rope strand 8 wounds around the spool 18 uniformly about the longitudinal axis of the spool 18. The guiding assembly may include a rod 61 which is arranged substantially parallel to the linear shaft 15 or the double grooved shaft 24. The rod 61 is configured to prevent the cylinder head 51 from co-rotating with the double grooved shaft 24 and to enable the cylinder head 51 to move linearly over the double grooved shaft 24.

In FIG. 10*b*, the guiding assembly includes a torque transmission unit 57. The torque transmission unit 57 is configured to be powered by the torque creating unit 55. The guiding assembly further includes a double grooved shaft 53. The double grooved shaft 53 is configured to be rotated by the torque transmission unit 57. In an example embodiment, the guiding assembly may include a linear shaft, having the double grooved shaft 53 mounted thereon, which is rotated by the torque transmission unit 57. In an example embodiment, the torque creating unit 55 may be configured to rotate a coaxial shaft 56 which in turn rotates or powers the torque transmission unit 57. The torque transmission unit 55 may be a gear system or a belt pulley system. The double grooved shaft 53 includes two helical grooves on the curved surface of the double grooved shaft 53. The double grooved shaft 53 may include a right handed helix and a left handed helix on its curved surface. The guiding assembly further includes a cylinder head 52. The cylinder head 52 may be mounted on the double grooved shaft 53. The cylinder head 52 comprises an engaging device or means which is configured to engage with one of the two helical grooves at a time to move the cylinder head 52 linearly over the double grooved shaft 53. The engaging device or means may be a protrusion or an attached ball bearing on an inner side of the cylinder head 52. As the cylinder head 52 moves linearly over the double grooved shaft 53, the rope strand 8 wounds around the spool 59 uniformly about the longitudinal axis of the spool 59. The guiding assembly may include a rod 62 which is arranged substantially parallel to the linear shaft or the double grooved shaft 53. The rod 62 is configured to prevent the cylinder head 52 from co-rotating with the double grooved shaft 53 and to enable the cylinder head 52 to move linearly over the double grooved shaft 53. The spool 59 is mounted on a shaft 54 which is also connected to the torque transmission unit 57 to assist in winding the rope strand 8 around the spool 59.

The cylinder head 51 or 52 is configured to move the rope strand 8 along the longitudinal axis of the spool 18 or 59 as the rope strand 8 is being wound on the spool 18 or 59.

In addition to the elements of the winding carrier 3 illustrated in FIG. 10*a*, in FIG. 10*c*, the guiding assembly includes a tension governing unit 75. The tension governing unit 75 is configured to adjust a pulling tension of the rope strand 8 coupled to the winding carrier 3 and to maintain the pulling tension below a predefined tension. The tension governing unit 75 is one of a slip clutch, an electronic control on a motor powering the three or more winding carriers 3, a torsion spring unit, a friction roller, torque limiters, ball detents, shear pins, magnetic limiters, and friction limiters. The tension governing unit 75 is configured to ensure that the pulling tension of the individual rope strands 8 never exceeds the set tension, when being pulled onto the spool 18. The tension governing unit 75 may also be configured to accelerate, decelerate, stall, and custom adjust the pulling rate of the individual rope strands 8 onto the spool 18 as required.

Figure 11:
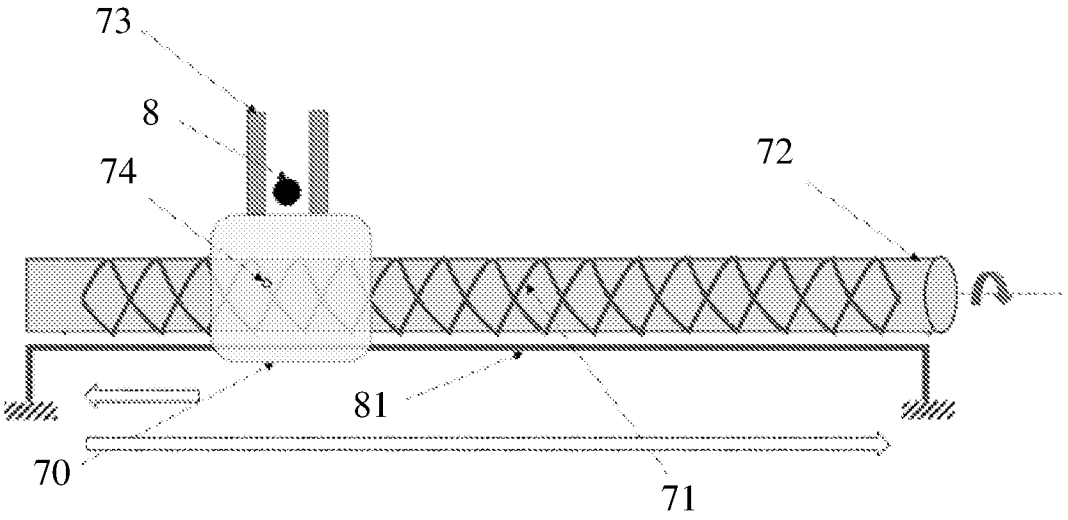
FIG. 11 illustrates a partial view of a winding carrier of a braid separation apparatus, in accordance with an implementation of the present subject matter.

FIG. 11 illustrates a partial view of the guiding assembly of the winding carrier 3. As shown in FIG. 11, the guiding assembly includes a cylinder head 70, a double grooved shaft, and a rod 81. The double grooved shaft has a shaft 72 with two helical and intersecting grooves 71 on the shaft, one right-handed and the other left-handed, such that the ends of the helical grooves 71 mect at the same point. As the shaft 72 rotates, the cylinder head 70 is constrained from rotation by the rod 81 (which is parallel to shaft 72) but the cylinder head 70 may move along the longitudinal axis of the shaft 72. The cylinder head 70 includes an internal protrusion 74 on the cylindrical head 70 which is configured to engage with the grooves 71 on the shaft 72 and to move along this groove 71 continuously. As the cylinder head 70 cannot rotate, the protrusion 74 follows the grooves until it reaches the end of the helix, where it shifts to the other helix with the opposite orientation and despite the shaft 72 rotating in the same direction. The protrusion 74 causes the cylindrical head 70 to move along the axis of the shaft 72 in the reverse direction until it encounters the end of this helical groove 71 and shifts to the other one, at which point the cylinder head 70 changes its direction of linear motion again. The cylinder head 70 may include a guide 73 through which the rope strand 8 passes to cause the rope strand 8 to move with the cylinder head 70. The guide 73 may be pins or an eyelet. This to and fro motion of the cylinder head 70 allows the rope strand 8 to be spooled up in a uniform manner on the spool 18.

While the power for the slot gear motion may be provided by an engine or a motor or any conventional source of torque, the winding carriers 3 themselves need a special source of power which can work despite the wide range of motion of these carriers. The winding carrier 3 may include a power source to power the torque creating unit 17 or 55. In an embodiment, the power source may be a battery or a coiled tension spring. In an alternate embodiment, the power source may be one or more electrical connections housed within the winding carrier 3. The one or more electrical connections may be powered by an external electrical power source. The one or more electrical connections may be one of slip rings, conductive brushes, sliding contact shoes and other current collector devices. Thus, power can be supplied to the winding carriers 3 by mounting the energy source powering the torque creating unit 17 or 55 on the winding carrier 3 itself, (e.g., a battery, or a coiled spring) or by electricity (AC or DC) which can be provided to the winding carriers 3 by way of providing one or more electrical connections to the moving winding carrier by way of slip rings, conductive brushes, sliding contact shoes or other current collector devices. The protrusion 21, or its associated plates 22 and 23, of the winding carriers 3 may be configured such that they may house a sliding contact or a contact shoe for one or more terminals of the electrical current. The bottom and top surface of the carrier base 19 may also be used as another contacting surface for a current collector. These current collectors may be used to power the torque creating unit 55 and 17 in the winding carrier 3.

Figure 12:
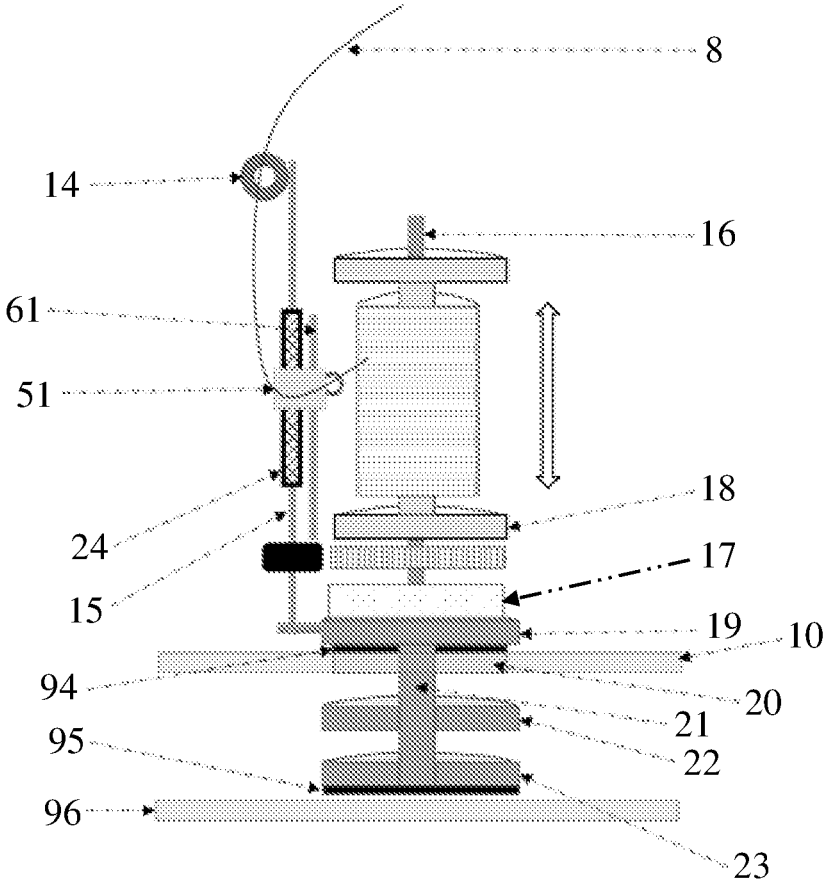
FIG. 12 illustrates a detailed view of a winding carrier of a braid separation apparatus, in accordance with an implementation of the present subject matter.

An implementation of such a configuration is shown in FIG. 12 which shows a winding carrier with current collectors. One set of current collectors 94 is placed on the interface on the carrier base 19 and the track plate 10. On one side is a portion of the surface of the winding carrier base 19 and this interfaces a portion of the surface on the top of the track plate 10. Wherever the winding carrier 3 moves on the sliding contact, as long as the current collector 94 on the carrier base 19 contacts the track plate 10, an electrical connection is established. These contacting surfaces will be present on a large portion of the surface of the track plate 10 which contacts the carrier base 19 during its motion on the serpentine path 11.

Another set of current collector surfaces 95 are at the plate 23 at the extreme end of the protrusion 21, and a plate 96 just below it which extends directly below and parallel to the entirety of the track plate 10. As the winding carriers 3 move along the serpentine path 11, the bottom of the winding carriers 3, i.e., plate 23, possesses a current collector surface 95 which can contact the current collector surface on the plate 96 while moving. This contact remains intact throughout the motion of the winding carrier 3.

These current collector surfaces 94 and 95 may be sheets or coatings of conductive materials, and some of these current collector surfaces may be composed of brushes, wheels, or other conventional moving current collectors. These conductive surfaces may be over the entire surface or over a portion of the surface as long as there is always a significant contact and transmission of current throughout the motion of the winding carriers 3.

These two current collectors can be used to transmit electricity as AC or DC to power the torque creating unit 55 and 17, and to control the speed, torque and other characteristics as desired. Digital signals may also be encoded into the current which may be decoded by a controller on the winding carrier 3 to control the motors on all winding spools either individually or as a group.

Aspects of the various embodiments described above can be combined to provide further embodiments. In general, in the following claims, the terms used should not be construed to limit the claims to the specific embodiments disclosed in the specification and the claims, but should be construed to include all possible embodiments along with the full scope of equivalents to which such claims are entitled.

We claim:

1. A braid separation apparatus comprising:

an input assembly configured to move a braided rope into the apparatus, wherein the braided rope comprises at least three rope strands; and three or more winding carriers, each one of the three or more winding carriers coupled to a rope strand of the at least three rope strands of the braided rope, wherein the three or more winding carriers move about each other in a serpentine path such that the at least three rope strands of the braided rope are separated, each of the three or more winding carriers comprising:

a spool connected to the rope strand coupled to the winding carrier; and a torque creating unit configured to provide a torque to the spool and to cause the spool to rotate such that the rope strand is wound around the spool.

2. The braid separation apparatus of claim 1, wherein each of the three or more winding carriers comprises:

a guiding assembly configured to move the rope strand in a to and fro motion and to cause the rope strand to be wound around the spool uniformly throughout a winding length of the spool.

3. The braid separation apparatus of claim 2, wherein the guiding assembly comprises:

a torque transmission unit powered by the torque creating unit;

a double grooved shaft, configured to be rotated by the torque transmission unit, wherein the double grooved shaft includes two helical grooves on a curved surface of the double grooved shaft; and a cylinder head mounted on the double grooved shaft, wherein the cylinder head comprises an engaging device configured to engage one of the two helical grooves at a time such that the cylinder head moves linearly over the double grooved shaft.

4. The braid separation apparatus of claim 3, wherein the cylinder head comprises a guide through which the rope strand coupled to the winding carrier passes, the guide configured to cause the rope strand to move with the cylinder head.

5. The braid separation apparatus of claim 3, wherein the torque transmission unit is one of a gear system and a belt pulley system.

6. The braid separation apparatus of claim 3, wherein the engaging device is one of a protrusion and an attached ball bearing on an inner side of the cylinder head.

7. The braid separation apparatus of claim 1, wherein each of the three or more winding carriers comprises:

a power source configured to power the torque creating unit.

8. The braid separation apparatus of claim 7, wherein the power source is one of a battery and a coiled tension spring.

9. The braid separation apparatus of claim 5, wherein the power source is one or more electrical connections housed within the winding carrier, wherein the one or more electrical connections is powered by an external electrical power source, and wherein the one or more electrical connections is one of slip rings, conductive brushes, and sliding contact shoes.

10. The braid separation apparatus of claim 1, wherein the torque creating unit is one of a motor and a coiled spring.

11. The braid separation apparatus of claim 1, wherein each of the three or more winding carriers comprises:

a tension governing unit configured to adjust a pulling tension of the rope strand coupled to the winding carrier and to maintain the pulling tension of the rope strand coupled to the winding carrier below a predefined tension.

12. The braid separation apparatus of claim 11, wherein the tension governing unit is one of a slip clutch, an electronic control on a motor powering the three or more winding carriers, a torsion spring unit, a friction roller, torque limiters, ball detents, shear pins, magnetic limiters, and friction limiters.

13. The braid separation apparatus of claim 1, wherein each of the three or more winding carriers comprises:

a shaft configured to carry the spool, wherein the shaft is configured to be rotated by the torque creating unit, and wherein the spool moves in a to and fro motion along the shaft such that the rope strand is wound around the spool uniformly throughout a winding length of the spool.

* * * * *